US005709181A

United States Patent [19]

Williams

[11] Patent Number: 5,709,181

[45] Date of Patent: Jan. 20, 1998

[54] ROCKER ARM ASSEMBLY

[75] Inventor: Antonio St. Clair Lloyd Williams, Rochester, N.Y.

[73] Assignee: General Motors Corporation, Detroit, Mich.

[21] Appl. No.: 795,749

[22] Filed: Feb. 6, 1997

[51] Int. Cl.[6] ..... F01L 1/24

[52] U.S. Cl. ..... 123/90.46; 123/90.55

[58] Field of Search ..... 123/90.39, 90.45, 123/90.46, 90.55, 90.59

[56] References Cited

U.S. PATENT DOCUMENTS

| | | | |
|---|---|---|---|
| 4,624,224 | 11/1986 | Kodama et al. | 123/90.46 |
| 4,699,094 | 10/1987 | Stegeman | 123/90.46 |
| 4,729,350 | 3/1988 | Speil | 123/90.46 |
| 4,815,424 | 3/1989 | Buuck et al. | 123/90.46 |
| 4,856,468 | 8/1989 | Speil et al. | 123/90.46 |
| 5,172,663 | 12/1992 | Fujiwara | 123/90.46 |

*Primary Examiner*—Weilun Lo

*Attorney, Agent, or Firm*—Karl F. Barr, Jr.

[57] ABSTRACT

A rocker arm and hydraulic lash adjuster assembly is disclosed. The assembly includes a shaft mounted rocker arm having a valve actuating arm portion which includes a stepped bore for slidingly receiving a hydraulic element. The bore has an open end, a cylindrical wall and a closed end having a spot face formed therein, and fluidly connected via a passage in the rocker arm to a source of pressurized fluid. The stepped bore is configured to receive a flat wear plate in abutment with the closed end and the hydraulic element such that the wear plate and the hydraulic element cooperate to define a fluid reservoir therebetween for pressurized fluid. The wear plate includes a centrally located through-bore operable to fluidly connect the fluid reservoir and the spot face formed integrally with the closed end of the stepped bore to define a passage from the source of pressurized fluid to the fluid reservoir to thereby fill the hydraulic element with pressurized fluid. The wear plate and hydraulic element cooperate to retain fluid within the fluid reservoir following a loss of pressurized fluid through operation of the centrally located through-bore extending through the wear plate which raises the level of the fluid in the fluid reservoir.

3 Claims, 2 Drawing Sheets

ROCKER ARM ASSEMBLY

TECHNICAL FIELD

The invention relates to valve actuation for internal combustion engines and, in particular, to rocker arm assemblies for actuating engine poppet valves.

BACKGROUND OF THE INVENTION

Rocker arm valve actuation is typically used to transfer rotational opening force generated by the cam lobes of a rotating camshaft to linear opening force required to actuate an engine poppet valve. The rocker arm is pivotally mounted on a rocker shaft and typically includes a contact surface or roller which follows the cam and a valve actuation, hydraulic element assembly for contact with the poppet valve. During operation, hydraulic fluid is supplied, under pressure, to the hydraulic element assembly which operates to compensate for lash in the valve train.

Loss of hydraulic fluid pressure which accompanies an engine shut-down has typically allowed the fluid in the hydraulic element assembly to drain. The result of hydraulic fluid drainage from the hydraulic element assembly is undesirable valvetrain noise following startup of the engine as the assembly is refilled and lash can again be compensated.

SUMMARY OF THE INVENTION

The present invention is directed to a rocker arm assembly having features which operate to prevent the drainage of hydraulic fluid from the hydraulic element assembly following loss of hydraulic pressure which accompanies an engine shut-down. The assembly includes a rocker arm mounted for pivotal movement on a rocker arm shaft. The rocker arm is operated by a rotating cam lobe, on an engine mounted cam shaft, to thereby urge the valve actuation foot of a hydraulic element assembly (HEA) mounted in the rocker arm to actuate an associated poppet valve.

A gallery in the rocker arm shaft supplies oil, under pressure, to a passage in the rocker arm. The pressurized oil is transferred to the oil reservoir in the hydraulic element assembly through an oil passage extending from the rocker arm shaft. The hydraulic element assembly is slidingly received in a cylindrical opening in the rocker arm and includes a plunger which abuts a wear plate inserted in the closed end thereof. The wear plate includes an oil opening in fluid communication with the rocker arm oil passage through a spot face integrally formed in the cylindrical opening of the rocker arm. Pressurized fluid in the passage may enter the HEA fluid chamber through the opening during operation of the engine and is prevented from leakage, out of the chamber by the fluid seal defined by contact between the plunger and the wear plate.

The rocker arm provides a means for valve actuation which is uniquely suited to extreme installation angles in which the hydraulic element assembly would otherwise drain following loss of engine oil pressure following an engine shut-down. The rocker arm assembly, by maintaining fluid within the hydraulic element assembly, minimizes valve train noise upon initialization of engine operation.

DESCRIPTION OF THE PREFERRED EMBODIMENT

Figure 1:
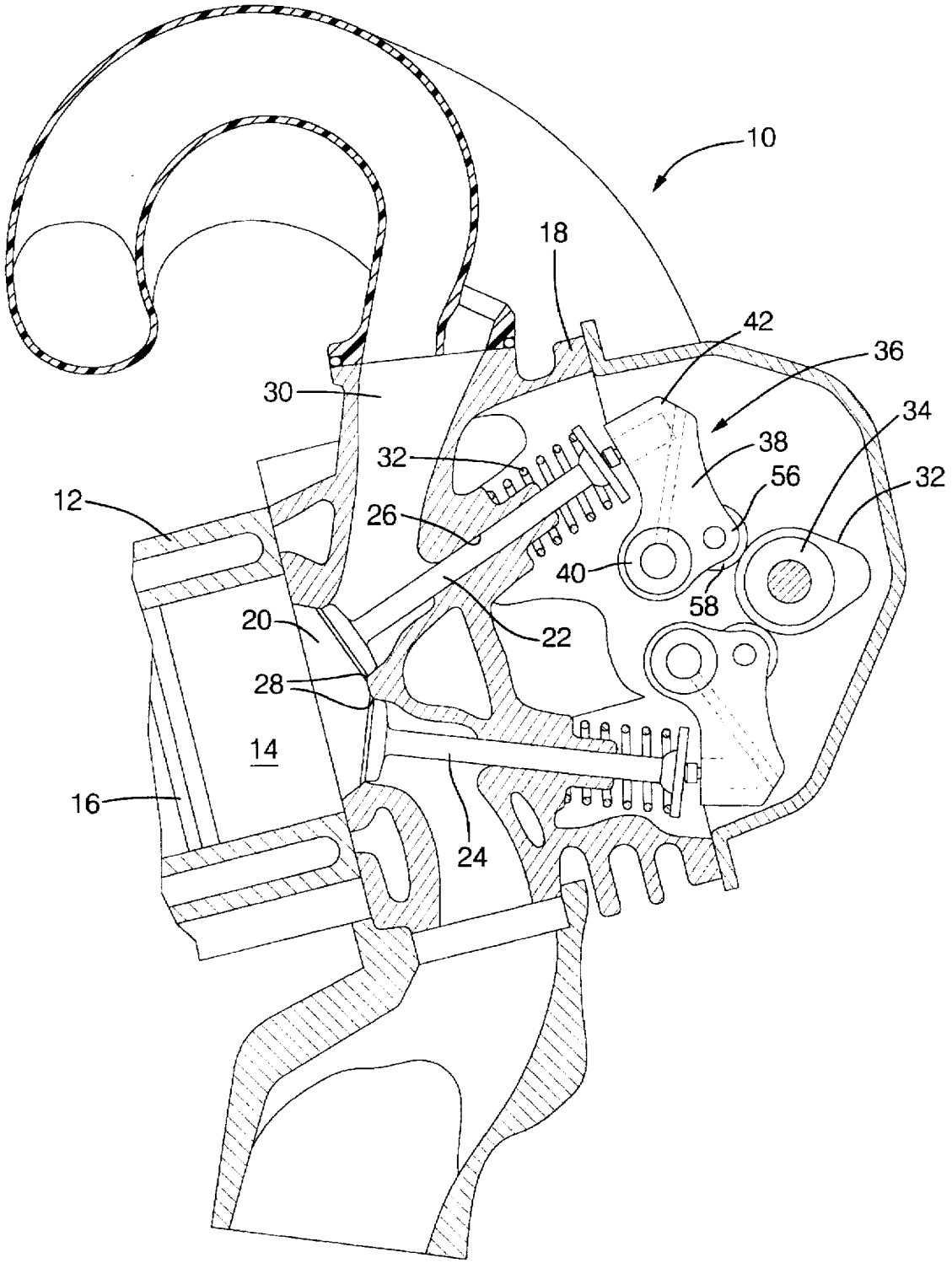
FIG. 1 is a partial, sectional view through an internal combustion engine illustrating features of the present invention.

Referring to FIG. 1, there is shown a portion of an overhead camshaft, internal combustion engine, designated generally as 10, having a cylinder block 12 including a number of cylinders 14 containing reciprocably moveable pistons 16. The cylinder block 12 supports a cylinder head 18 which closes the ends of the cylinders 14 to define combustion chambers 20. The cylinder head 18 carries intake and exhaust valves 22 and 24 which operate to control the admission of combustion air and fuel to the cylinders and the discharge of exhaust constituents therefrom.

Focusing for clarity on only intake poppet valve 22, the valve is supported in guide bore 26 in cylinder head 18, and moves reciprocally, into and out of sealing engagement with valve seat 28, to open or close intake port 30. The stem of intake poppet valve 22 is normally biased to a valve closed position by a return spring 32 disposed coaxially thereabout.

The intake poppet valve 22 is operated on by a rotatable cam 32 disposed on a camshaft 34 via a rocker arm assembly 36. The rocker arm 38 of rocker arm assembly 36 is rotatably supported above the cylinder head 18 on a rocker shaft 40 and includes a valve actuator arm 42 which overlies the valve 22. A hydraulic lash adjuster 44, FIG. 2, is received within a stepped bore 46 in the valve actuator arm 42, and operates as an interface between the poppet valve 22 and the rocker arm assembly 36 to adjust for lash occurring therebetween.

The rocker shaft 40 is supported above the cylinder head 18 and includes an axially extending bore 48 which is in continuous, fluid communication with a source of pressurized lubricant supplied by the engine 10. The rocker shaft 40 is provided with at least one rise passage 50, for each rocker arm 38, that communicates with an annular groove 52 provided in either the outer peripheral surface of the rocker shaft 40 or, as shown, the inner peripheral surface of the bore 54 of the rocker arm 38.

In the construction illustrated, the cam actuated rocker arm 38 is bifurcated intermediate of its ends to define spaced apart roller supports 56, so as to loosely receive a cam follower roller 58 rotationally supported on a shaft 60 which extends through, and is fixed in, suitable apertures 62 provided for the purpose in the roller supports 56.

Figure 2:
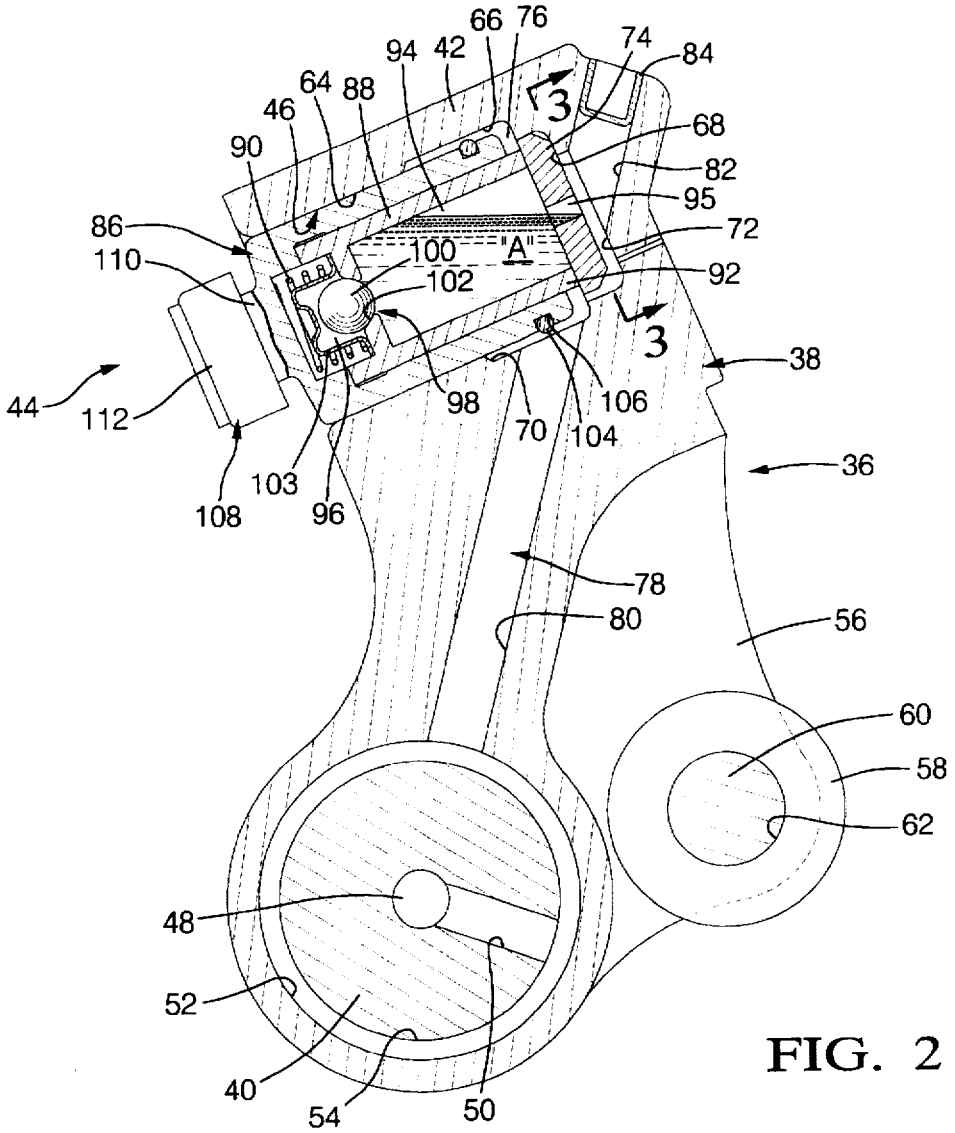
FIG. 2 is an enlarged view of the rocker arm and hydraulic lash adjuster assembly of the engine of FIG. 1.
Figure 3:
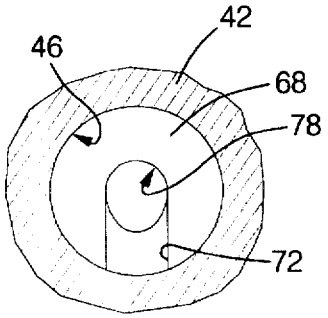
FIG. 3 is a sectional view taken along line 3—3 of FIG. 2.

The rocker arm 38 is provided with a stepped bore 46 so as to define in succession, starting from the lower end as viewed in FIG. 2, a cylindrical follower body guide wall 64, an upper wall 66 and a terminal end 68. The follower body guide wall 64 is of a diameter less than that of the upper wall 66 and is connected to the upper wall by a shoulder 70. A spot face or recess 72 is formed in the terminal end 68 and extends radially from the center of the terminal end to intersect with the upper wall 66. The stepped bore 46 receives a wear plate 74 that is positioned within the upper wall portion 66 in abutment with the terminal end 68.

The rocker arm 38 includes an axial fluid passage 78 which extends substantially the length of the arm and intersects the annular groove 52 at a first end 80 and the upper wall portion 66 of the stepped bore 46 closely adjacent a second end 82. The second end 82 of the fluid passage 78 receives a plug 84 to prevent leakage of fluid therefrom.

The hydraulic lash adjuster 44 is of substantially conventional construction and includes a cup shaped, cylindrical follower body 86 that is slideably received within the follower body guide wall 64 of the stepped bore 46. A plunger or piston 88 is disposed within the cylindrical follower body 86 for reciprocation therein, and is normally biased upwardly by a plunger spring 90 so that its upper end 92 abuts against the lower surface of wear plate 74. The plunger spring 90 also acts against the closed end of the follower body 86 so as to maintain the hydraulic lash adjuster 44 in operative engagement with the terminal end of the poppet valve 22.

The lower surface of the wear disc 74 forms, with the upper end 92 of plunger 88, a fluid reservoir 94 which is in flow communication with pressurized fluid in the rise passage 78 via a through passage 95, located centrally of, and extending through the wear plate 74, and the spot face 72. The spot face 72 in rocker arm 38 receives pressurized fluid from the riser 48 through intersecting axial passage 78. The fluid reservoir 94 is in flow communication with a pressure chamber 96 via a port 98, flow through which is controlled by a one-way valve in the form of a ball 100 which closes against a seat 102 disposed about the port 98.

A suitable valve cage 103 limits open travel of the valve ball 100 to that necessary to accommodate replenishment of the pressure chamber 96 with oil which normally escapes therefrom, between the sliding surfaces of the piston 88 and the follower body 86 as "leak-down" during cam induced opening movements of the poppet valve 22.

The hydraulic lash adjuster 44 is axially retained, for limited movement within the stepped bore 46 by means of a retainer ring 104 located in annular groove 106, provided for this purpose, in the outer peripheral surface of the follower body 86, whereby the retainer ring 104 registers with the shoulder 70 to thereby limit the downward travel of the follower body, as viewed in FIG. 2.

In the embodiment shown in the Figures, the follower body 86 of the hydraulic lash adjuster is provided at its closed end with a depending actuator 108 that includes an axially extending neck portion 110 terminated, at its lower end, with an enlarged diameter actuating head, not shown, which receives a foot assembly 112. The foot assembly 112 allows relative movement between the lash adjusters body 86, as the rocker arm pivots, and the valve 22 during operation of the engine.

FIGS. 1 and 2 illustrate the operation of the invention disclosed herein. In engine applications requiring large angles of installation for the hydraulic lash adjuster 44, the wear plate 74 establishes a sealing interface with the upper end 92 of the plunger 88 to thereby limit the loss of fluid from reservoir 94 following engine shut down and subsequent loss of fluid pressure. The plunger spring 90 assures continuity of the sealing interface by maintaining the plunger 88 and the wear plate 74 in constant contact. As described, fluid enters the reservoir 94 by way of the through passage 95 located centrally of the wear plate 74 which is fed by fluid in the integral spot face 72 formed in the terminal end 68 of the stepped bore 46 of rocker arm 38. Following engine shut-down, fluid is prevented from exiting the fluid chamber 94 by the sealing interface and is limited to drainage through the opening 95, resulting in a greater retained volume of fluid "A" in the reservoir which is sufficient to fill the pressure chamber 96 immediately upon engine start-up. By increasing the volume of residual oil in the fluid chamber 94, operation of the lash adjuster upon engine start-up is immediate, thereby minimizing valve train related noise resulting from inoperable lash adjusters.

Figure 4:
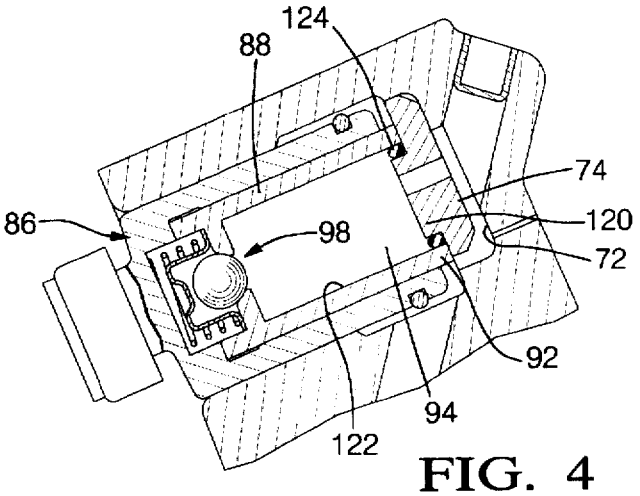
FIG. 4 illustrates a second embodiment of the rocker arm and lash adjuster assembly of FIG. 2.

FIG. 4 illustrates an alternative embodiment of the present invention in which like features are represented by like numerals as those already described. Should additional sealing be required at the interface between the plunger piston 88 and the lower surface of the wear plate 74, the wear plate may be formed with an annulus 120 on the lower surface thereof which is insertable into the plunger in circumjacent relationship to the inner cylindrical surface 122 thereof. A resilient sealing member such as o-ring 124 may be installed around the annulus 120 such that following insertion of the annulus into the plunger 88 the o-ring defines a seal between the annulus 120 and the inner cylindrical surface 122 of the plunger.

The present invention is directed to a hydraulic lash adjuster for application in an internal combustion engine where extreme angles of installation subject typical lash adjusters to drainage following engine shut-down. The hydraulic lash adjuster disclosed, utilizes a sealing interface between the wear plate and the lash adjuster plunger to retain fluid in the fluid reservoir. A spot face integral with the rocker arm stepped bore supplies pressurized fluid to the reservoir via a centrally located bore which extends through the wear plate.

The foregoing description of the preferred embodiments of the invention has been presented for the purpose of illustration and description. It is not intended to be exhaustive nor is it intended to limit the invention to the precise forms disclosed. It will be apparent to those skilled in the art that the disclosed embodiments may be modified in light of the above teachings. The embodiments described were chosen to provide an illustration of the principles of the invention and of its practical application to thereby enable one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

I claim:

1. A rocker arm and hydraulic lash adjuster assembly including a shaft mounted rocker arm having a valve actuating arm portion, said valve actuating arm portion including a stepped bore for slidingly receiving a hydraulic element therein, said bore including an open end, a cylindrical wall and a closed end having a recess formed therein, and fluidly connected via a passage in said rocker arm to a source of pressurized fluid, said stepped bore configured to receive a flat wear plate in abutment with said closed end and said hydraulic element such that said wear plate and said hydraulic element cooperate to define a fluid reservoir therebetween for pressurized fluid, and said wear plate including a centrally located through-bore extending therethrough to fluidly connect said fluid reservoir and said spot face formed integrally with said closed wall to define a passage from said source of pressurized fluid to said fluid reservoir to thereby fill said hydraulic element with pressurized fluid.

2. A rocker arm and hydraulic lash adjuster assembly, as defined in claim 1, said wear plate and said hydraulic element cooperable to retain fluid within said fluid reservoir following a loss of pressurized fluid in said passage through operation of said centrally located through-bore extending through said wear plate.

3. A rocker arm and hydraulic lash adjuster assembly, as defined in claim 2, said wear plate including an annulus insertable in said hydraulic element assembly and operable to receive a resilient sealing member thereabout to define a fluid resistant seal against leakage of fluid from said fluid reservoir.

* * * * *